United States Patent [19]

Tomlinson et al.

[11] Patent Number: 4,902,073

[45] Date of Patent: Feb. 20, 1990

[54] CUTTER PICK FOR MINING USING HYDRAULIC STREAM

[76] Inventors: Peter N. Tomlinson, 315 Enford Road, Mondeor, Johannesburg, Transvaal; Klaus Tank, 9 Warbleton Avenue, Essexwold, Bedfordview, Transvaal, both of South Africa

[21] Appl. No.: 263,009

[22] Filed: Oct. 26, 1988

[30] Foreign Application Priority Data

Oct. 26, 1987 [ZA] South Africa ..... 87/8016

[51] Int. Cl.[4] ..... F21B 10/60; F21C 35/18

[52] U.S. Cl. ..... 299/81; 175/329; 175/393; 299/17

[58] Field of Search ..... 299/79, 81, 17; 175/329, 393

[56] References Cited

U.S. PATENT DOCUMENTS

| | | | |
|---|---|---|---|
| 4,280,735 | 7/1981 | Löbbe | 299/81 |
| 4,606,418 | 8/1986 | Thompson | 175/329 |
| 4,678,237 | 7/1987 | Collin | 299/79 |
| 4,765,687 | 8/1988 | Parrot | 299/81 |

FOREIGN PATENT DOCUMENTS

| | | | |
|---|---|---|---|
| 2817796 | 10/1979 | Fed. Rep. of Germany | 299/81 |
| 3403344 | 8/1985 | Fed. Rep. of Germany | 299/81 |
| 805766 | 9/1980 | South Africa . | |
| 2041043 | 9/1980 | United Kingdom | 299/81 |
| 2087949 | 6/1982 | United Kingdom . | |
| 2113743 | 8/1983 | United Kingdom . | |
| 2174025 | 10/1986 | United Kingdom . | |

*Primary Examiner*—Stephen J. Novosad
*Assistant Examiner*—David J. Bagnell
*Attorney, Agent, or Firm*—Scully, Scott, Murphy & Presser

[57] ABSTRACT

A cutter pick for a mining machine has a lug carrying a cutting tip of hard, abrasion resistant material at its forward end. A passage extends through the lug with provision at its rearward end for connection to a source of high pressure liquid and with a nozzle at its leading end venting through the cutting tip. The intention is that high pressure liquid issueing from the nozzle will degrade the rock before it is attacked by the cutting tip.

6 Claims, 1 Drawing Sheet

CUTTER PICK FOR MINING USING HYDRAULIC STREAM

BACKGROUND TO THE INVENTION

This invention relates to cutter picks such as are mounted on drums on mining machines used to cut soft materials such as coal.

It is known from South African patent No. 80/5766 to direct water onto the surface of the material being cut in advance of the cutting tip of the pick. The intention in this case is to cool the pick and thereby to prolong its working life.

SUMMARY OF THE INVENTION

According to the present invention, a cutter pick for a mining machine comprises a lug, a cutting tip of hard, abrasion resistant material located at the forward end of the lug and a passage which is connectable at its rearward end to a source of high pressure liquid and which extends through the lug to vent at its forward end through the cutting tip.

Typically, the cutting tip will comprise a PCD (polycrystalline diamond) compact or a CBN (cubic boron nitride) compact. In either case, the compact may be carried by a tungsten carbide backing secured to a body of similar material which is in turn secured to the lug.

In one version of the invention, the forward end of the passage vents normally to the plane face of the compact while in another version it vents at acute angle to that face.

BRIEF DESCRIPTION OF THE DRAWINGS

Two embodiments of the invention will now be described, by way of example only, with reference to the accompanying drawings in which.

DESCRIPTION OF EMBODIMENTS

Figure 1:
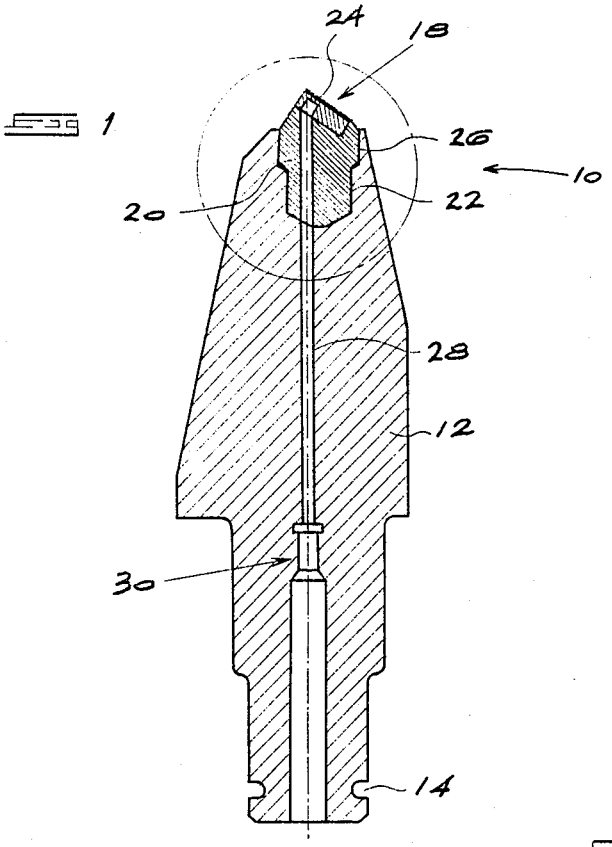
FIG. 1 shows a cross-sectional view of a cutter pick of the invention.

In FIG. 1, the steel lug of a cutter pick 10 is designated with the reference number 12. At its rearward end, the lug has a circumferential groove 14 for receiving a clip (not shown) which is used to secure the pick to the periphery of the rotating drum of a mining machine (not shown) used to cut soft materials such as coal. At the forward end of the lug there is a cutting tip 18 which is carried by a tungsten carbide body 20 secured in a pocket 22 formed in the lug 12. The cutting tip is composed of a PCD layer 24 on a tungsten carbide backing 26, the backing in turn being brazed to the body 20. The manner in which these components are secured together is well known in the art.

A passage 28 extends through the lug 12, through the body 20, through the backing 26 and through the PCD layer 24. In the illustrated case, the passage has a greater cross-sectional area towards the rearward end of the lug and then steps down in cross-section at the region 30. The passage is connected in use to a supply of high pressure water. This can be achieved in practice by means of a spigot extending into the large diameter rearward section of the passage, suitable 0-ring seals being located in the region 30 to ensure good sealing.

Where the passage in FIG. 1 passes from the body 20 into the backing 26, it experiences a change in direction (see FIG. 2) with the result that it vents at the plane face 32 of the PCD layer 24 in a direction normal to that plane face. Near to its forward end, the passage tapers down sharply in cross-section with the result that a very narrow nozzle only extends through the PCD layer. In the illustrated case, the angle 34 is 35°, which means that the passage 28 undergoes a change in direction of this magnitude on passing from the body 20 into the backing 26.

Figure 2:
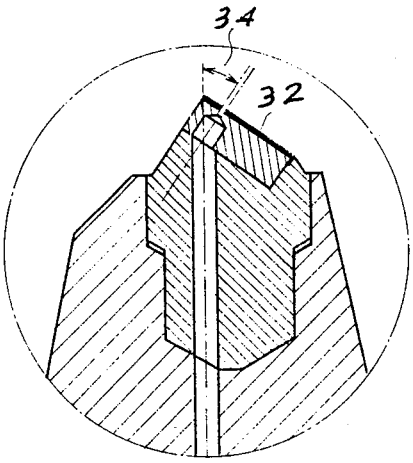
FIG. 2 shows an enlargement of the circled area in FIG. 1.
Figure 3:
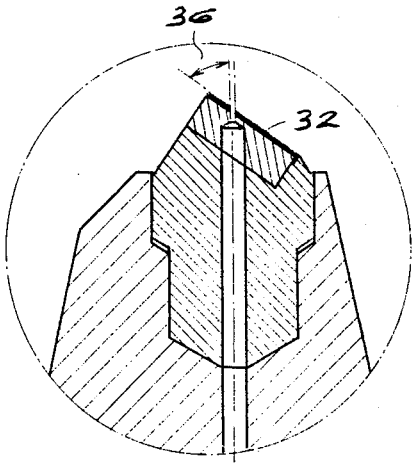
FIG. 3 shows a view similar to that of FIG. 2, but of another embodiment.

The embodiment of FIG. 3 differs from that of FIGS. 1 and 2 only in that the passage undergoes no change of direction at all. The narrow nozzle in this case vents at an acute angle 36 of 55° to the plane face of the PCD layer.

With a source of high pressure water connected to the passage in use, a high velocity jet of water will issue from the face of the cutting tip and impinge on the coal or other material shortly before it is attacked by the cutting tip. The purpose of the high pressure jet is to loosen and degrade the material with the result that the tip itself does less work in cutting the material. It is anticipated that the working life of the cutting tip, and the pick as a whole, can be extended as a result of this feature.

We claim:

1. A cutter pick for a mining machine, the cutter pick comprising: (a) a lug; (b) a cutting insert at a forward end of the lug, the cutting insert including a forward layer of hard, abrasion resistant material presenting a planar cutting face carried by a carbide backing, said carbide backing secured to a carbide body which is secured to the lug; and (c) a passage extending forwardly through the lug from the rearward end of the lug, through the carbide backing and through the forward layer so as to vent through the cutting face, the passage at its rearward end being connectable to a source of high pressure liquid and with its forward end, at a location inside the carbide backing, undergoing a reduction in cross-section so that, in use, a high pressure jet of liquid issues through the cutting face to impinge on and degrade a rock face ahead of the cutting insert.

2. A cutter pick according to claim 1 wherein the forward end of the passage vents normally to the planar cutting face.

3. A cutter pick according to claim 1 wherein the forward end of the passage vents at an acute angle to the planar cutting face.

4. A cutter pick according to claim 1 wherein the rearward end of the passage is enlarged relative to the remainder of the passage for reception of a spigot connected to a supply of high pressure liquid.

5. A cutter pick according to claim 1 wherein the forward layer of hard, abrasion resistant material is one of a PCD layer and CNB layer.

6. A cutter pick according to claim 1 wherein the reduction in cross-section of the passage inside the carbide backing ends substantially adjacent to the surface of the backing bordering the forward layer.

* * * * *